United States Patent [19]

Buras et al.

[11] Patent Number: 4,461,354

[45] Date of Patent: Jul. 24, 1984

[54] HYDRAULIC WELL CAP

[76] Inventors: Allen M. Buras, 109 E. Collins Dr., Buras, La. 70041; Robert E. Prest, III, P.O. Box 95, Empire Machine Works, Inc., Empire, La. 70050

[21] Appl. No.: 292,703

[22] Filed: Aug. 13, 1981

[51] Int. Cl.[3] ..... E21B 33/064; E21B 19/16; E21B 43/12

[52] U.S. Cl. ..... 166/343; 166/97; 166/85; 166/363; 285/DIG. 13; 285/18

[58] Field of Search ..... 166/85, 79, 93, 96, 166/77, 97, 90, 363, 368, 351, 338, 344, 364, 341, 343, 77.5; 285/18, 39, DIG. 13, DIG. 21, 280; 251/1 R, 1 A, 1 B

[56] References Cited

U.S. PATENT DOCUMENTS

| | | | |
|---|---|---|---|
| 910,295 | 1/1909 | Layne | 166/90 |
| 1,735,991 | 10/1929 | Bennett | 285/DIG. 13 |
| 2,126,933 | 8/1938 | Stone et al. | 166/77 |
| 2,322,679 | 6/1943 | Williamson | 285/280 |
| 2,638,222 | 5/1953 | Roach | 285/DIG. 13 |
| 3,257,099 | 6/1966 | Merritt, Jr. | 254/105 |
| 3,272,222 | 9/1966 | Allen | 137/315 |
| 3,325,190 | 6/1967 | Eckert et al. | 166/338 |
| 3,999,782 | 12/1976 | Shotbolt et al. | 285/DIG. 13 |
| 4,026,354 | 5/1977 | Burrow | 285/DIG. 13 |
| 4,291,762 | 9/1981 | Gudgel | 166/85 |

FOREIGN PATENT DOCUMENTS

| | | | |
|---|---|---|---|
| 1085273 | 9/1967 | United Kingdom | 285/DIG. 21 |

*Primary Examiner*—James A. Leppink
*Assistant Examiner*—Hoang C. Dang
*Attorney, Agent, or Firm*—Finnegan, Henderson, Farabow, Garrett & Dunner

[57] ABSTRACT

Apparatus and associated method for capping a blowing well, one embodiment of the apparatus including a hydraulically activated clamp for engaging the exposed well pipe stem, a hydraulically operated shut off valve having a tapered fitting and hydraulically activated pistons connecting the clamp and the valve for axially displacing the fitting into sealing engagement with the open end of the pipe stem. A preferred embodiment substitutes a hydraulic motor driven threaded coupling for the connecting pistons and includes thread-forming dies or taps on the tapered fitting.

34 Claims, 7 Drawing Figures

HYDRAULIC WELL CAP

BACKGROUND OF THE INVENTION

1. Field of the Invention

The hydraulic well cap of the present invention comprises apparatus for capping a well having a pipe stem through which fluid is flowing uncontrollably, such as a gas well or an oil well.

2. Description of the Prior Art

Problems stemming from the uncontrolled flow from oil and gas wells have long been appreciated by those working in the well supply equipment field. The loss of valuable fluid, the contamination of the surrounding environment, and the damage to supporting the equipment all have prompted the development of various devices and techniques for attempting to cap such wells. The potential flammability of the issuing fluid as well as the high fluid velocity make exceedingly dangerous and often impossible as the use of conventional procedures and equipment for securing capping apparatus to the well stem, often necessitating remote control operation. These problems are, of course, compounded if the location of the blowing well is on the ocean floor.

Prior attempts to solve this problem have included apparatus such as shown in U.S. Pat. No. 4,192,376 that is intended to be guided over the flowing type stem whereupon the force of the fluid would act to seat and engage a clamping device and then activate a valve mechanism to finally shut off the flowing well. The principal difficulties in the use of such devices is that they lack the ability to provide a positive coupling and sealing engagement between the pipe stem end and the capping apparatus. Failure to achieve complete engagement between the pipe stem and the capping apparatus can result in an unacceptable rate of leakage and the possibility of the capping apparatus being "blown off" of the well stem when the valve component of the apparatus is activated to shut off the flow, due to the tremendous fluid pressures in the subterranean fluid reservoir and the inertial forces of the high velocity fluid in the pipe stem.

SUMMARY OF THE INVENTION

In accordance with the purpose of the invention, as broadly embodied and broadly described herein, the apparatus for capping a well having a pipe stem through the end of which fluid is flowing uncontrollably comprises a valve having a flow passage means for coupling said valve to the pipe stem, the pipe-coupling means having a flow passage therethrough communicating with the valve flow passage means for clamping the valve to the pipe stem with the flow passage of pipe-coupling means axially aligned with the pipe stem end; and means for axially displacing the pipe-coupling means relative to said clamping means into fluid-tight engagement with the pipe stem end, the displacing means acting against the pipe stem through the clamping means.

Preferably, the valve is a double-ram piston, hydraulically-activated blow-out preventor valve, and the clamping means includes a split-type clamp having a plurality of hardened jaws for securely engaging the pipe stem outer wall and preventing motion relative to the pipe stem.

It is also preferred that, where a threaded coupling is desired, the pipe-coupling means have a threaded sealing member and include means for forming threads on the pipe stem adjacent the pipe stem end and that the means for axially displacing the pipe-coupling means into fluid-tight engagement with the pipe stem end further include means for rotating the threaded sealing-member means in axially advancing engagement with the threaded pipe stem end, the forming and rotating means acting against the pipe stem through the clamping means.

It is still further preferred that where the pipe stem and the pipe-coupling means are rotating and the displacing means includes means for rotating the pipe-coupling means in axially advancing relationship with the pipe stem end, the apparatus further include means for isolating the valve against the rotary motion of the pipe-coupling means.

And it is still further preferred that where thread-forming means are utilized, the rotary means also include means connected between the clamping means and the pipe-coupling means for advancing the thread-forming means along the pipe stem at the same rate the threads are being formed by the thread-forming means.

The accompanying drawings which are incorporated in, and constitute a part of this specification, illustrate two embodiments of the invention and, together with the description, serve to explain the principles of the invention.

DESCRIPTION OF THE PREFERRED EMBODIMENT

Reference will now be made in detail to the present preferred embodiments of the invention, examples of which are illustrated in the accompanying drawings.

Figure 1:
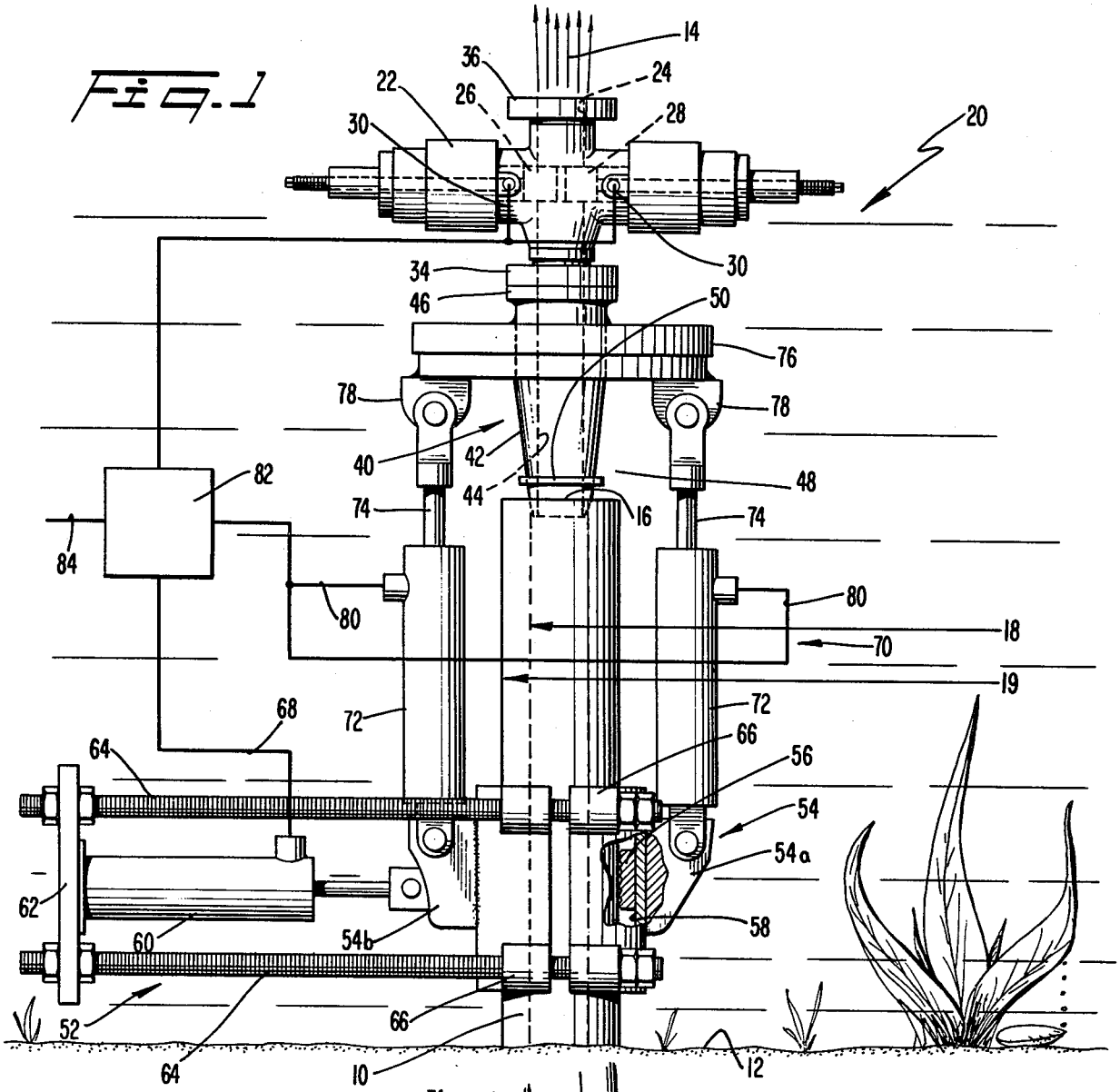
FIG. 1 is a schematic view of a hydraulic well cap apparatus constructed in accordance with the present invention.

In FIG. 1 there is depicted generally a first embodiment of the present invention, namely apparatus 20, for capping a "blowing" well such as a well pipe stem 10 projecting above the ocean floor 12. In FIG. 1, fluid 14 is shown flowing uncontrollably from the pipe end 16 such as could occur during drilling operations upon penetration of an ultra-high pressure gas reservoir or another body of fluid under high pressure. Pipe stem 10 has an inside diameter (ID) 18 and an outside diameter (OD) 19 of conventional sizes. The present invention to be described hereinafter is not limited to the undersea operation as shown in FIG. 1 but is equally adapted for use on dry land.

In accordance with the present invention, apparatus 20 includes a valve for finally throttling the flow through the pipe stem, the valve to be activated after the apparatus 20 is in place, as will be discussed hereinafter. As embodied herein, and with continued reference to FIG. 1, valve 22 is a hydraulically activated blow-out preventor (BOP) valve, preferably of the opposed double-piston type similar to that shown in U.S. Pat. No. 3,272,222. These valves are characterized by a central fluid passageway 24 closable by opposing ram pistons 26, 28 which are pressure activated through appropriate hydraulic connections 30. Flange 34 allows valve 22 to be conventionally attached to the remainder of the capping apparatus 20 such as by high-strength bolts (not shown). Flange 36 is used to attach valve 22 to apparatus (not shown) to pump drilling fluids into the well after the well has been capped in order to help "kill" the well and/or to draw off fluid when the flow has been brought under control. Other valve types such as hydraulically operated gate valves (not shown) can be used and are also considered within the scope of the invention.

In accordance with the invention, there is further provided means for flow-coupling the valves to the pipe stem. As embodied herein, pipe-coupling means 40 includes a tapered plug 42 having a hollow bore 44 and a flange end 46 for connecting to the flange 34 of valve 22, such as by appropriate bolts (not shown). The bore 44 and valve passageway 24 are flow-connected and ideally of approximately the same diameter such that fluid 14 can pass with a minimum pressure drop through the apparatus 20 prior to the actuation of valve 22.

Preferably, the exterior tapered surface 48 of plug 42 is smooth and the upper of plug 42 is such as to produce a fluid-tight press-fit between surface 48 and ID 18 of pipe stem 10 when plug 42 is axially displaced into engagement with end 16 of pipe stem 10. It may be additionally preferred that one or more sealing rings 50 be located on the exterior surface 48 to provide extra sealing protection. Sealing ring 50 can be made of copper, bronze or any sealing material conventionally used in high pressure sealing applications.

Figure 2:
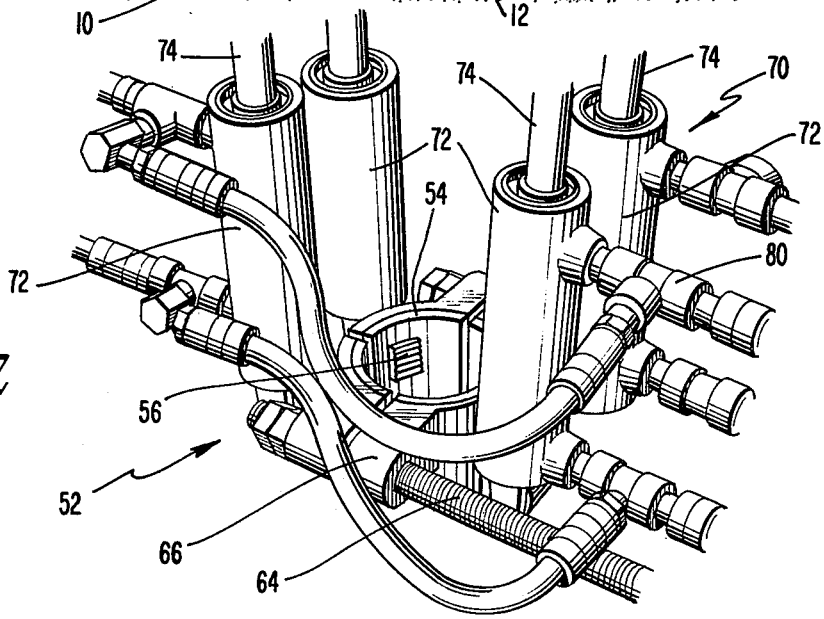
FIG. 2 is a detail of part of the apparatus shown in FIG. 1.

In accordance with the present invention, there is further provided means for clamping the apparatus to the pipe stem. As embodied herein, and as seen in FIGS. 1 and 2, clamping means 52 includes a split-type hollow bore clamp 54 with opposing sections 54*a*, 54*b*. Preferably, a plurality of hardened jaws 56 are positioned in the bore 58 of clamp 54 to provide a non-slip engagement with OD 19 of pipe stem 10 upon activation of clamp 54. Jaws 56 can be permanently fixed to clamp 54 as shown or preferably can be adjustable to accommodate different pipe stems sizes.

In the embodiment shown in FIGS. 1 and 2, sections 54*a*, 54*b* are urged together by a hydraulic cylinder 60 acting between mounting frame 62 and clamp section 54*b*. A plurality of threaded rods 64 are attached to and connect the frame 62 and the clamp section 54*a* and guide the movement of clamp section 54*b* via guides 66 into engagement with pipe stem 10. Hydraulic cylinder 60 is activated through hydraulic connections 68. It is evident that other means can be utilized to activate clamp 54 and such variations are considered within the scope of the present invention.

In accordance with the present invention there is further provided means for axially displacing the pipe-coupling means and the attached valve, relative to the clamping means, into fluid-tight engagement with the pipe stem end. As embodied herein, displacing means 70 includes a plurality of hydraulic cylinders 72 of the positive retraction type (i.e., the associated piston withdraws upon an increase in hydraulic pressure ) connected between clamp 54 and pipe-coupling means 40. As shown in FIG. 1, the cylinders 72 are attached by a conventional means to clamp 54, and the associated pistons 74 are secured to mounting plate 76 by hinge connections 78. Mounting plate 76 is secured to hollow tapered plug 42 by any convenient means such as by the weldments shown in the drawing. The hinge connections 78 are intended to compensate for any misalignment between the axes of cylinders 72 and the axis of pipe stem 10. Cylinders 72 are activated by hydraulic connections 80.

It is further preferred that a single hydraulic control unit 82 to be used to selectively supply hydraulic fluid under pressure to the hydraulic connections 30, 68, and 80 as each of the BOP valve 22, the clamp 54, and the displacing means 70 are hydraulically activated. Thus, a controller such as control unit 82 with a single hydraulic input source 84 can be used advantageously to provide a minimum of extended hydraulic lead lines.

In operation, the apparatus 20, with valve 22 being in the full-open position, is manuevered over the flowing pipe stem 10 and lowered until clamp 54, also in the full-open position, surrounds the pipe stem 10 and the plug 42 just contacts the pipe stem end 16. The flow passage through the apparatus 20 afforded by valve passageway 24 and the plug bore 44 is expected to provide an acceptably low flow resistance to the manuevering and lowering steps. When plug 42 contacts and is axially aligned with pipe stem end 16, the clamp closing hydraulic cylinder 60 is activated thereby forcing the clamp sections 54*a*, 54*b* to engage pipe stem 10. The tapered plug 42 is itself expected to provide the alignment as the lead portions of the plug 42 will have a smaller OD than the pipe items ID and thus serve as a pilot for the remainder of plug 42.

Following the clamping procedure, the hydraulic closure cylinders 72 are activated through hydraulic connections 80 to displace the tapered plug 42 axially into a press-fit engagement with pipe stem end 16 until sealing rings 50 are engaged and/or until a sufficient interference fit is obtained. In this step, the displacing force on plug 42 is taken up by the clamp 54 acting against the pipe stem 10, through the mounting plate 76 and cylinder 72. The axially engaging movement between plug 42 and pipe end 16 ensures positive fluid-tight engagement between apparatus 20 and pipe stem 10.

Finally, BOP valve 22 is activated through hydraulic connections 30 and the double-ram pistons 26, 28 close off the passageway 24 to throttle and stop the fluid flow 14. Subsequently, drilling fluids can be pumped into the well to help "kill" it and/or fluid can be tapped off through the BOP valve 22 via the flange 36 connection.

Figure 3:
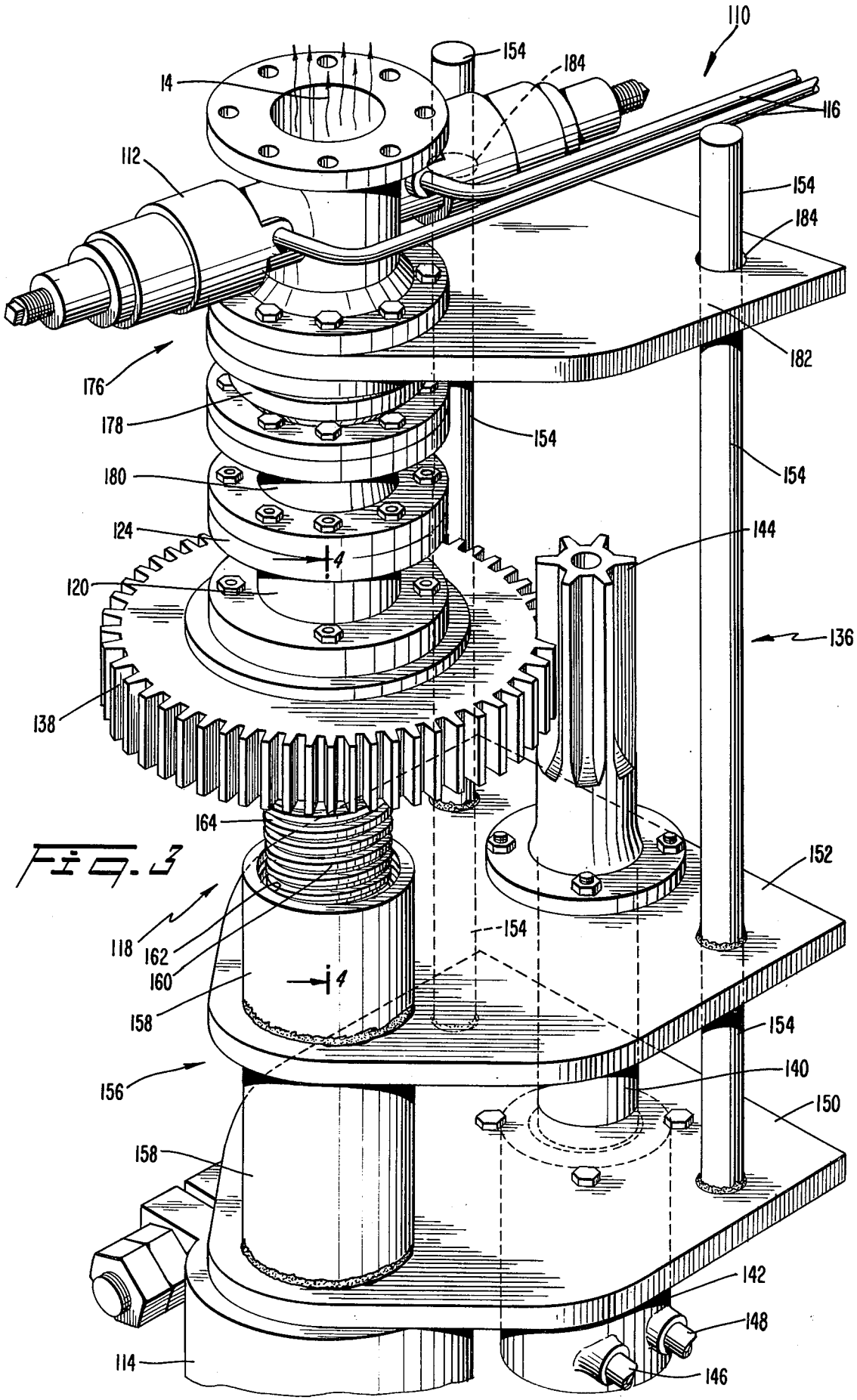
FIG. 3 is a schematic view of a portion of another hydraulic well cap apparatus constructed in accordance with the present invention.
Figure 4A:
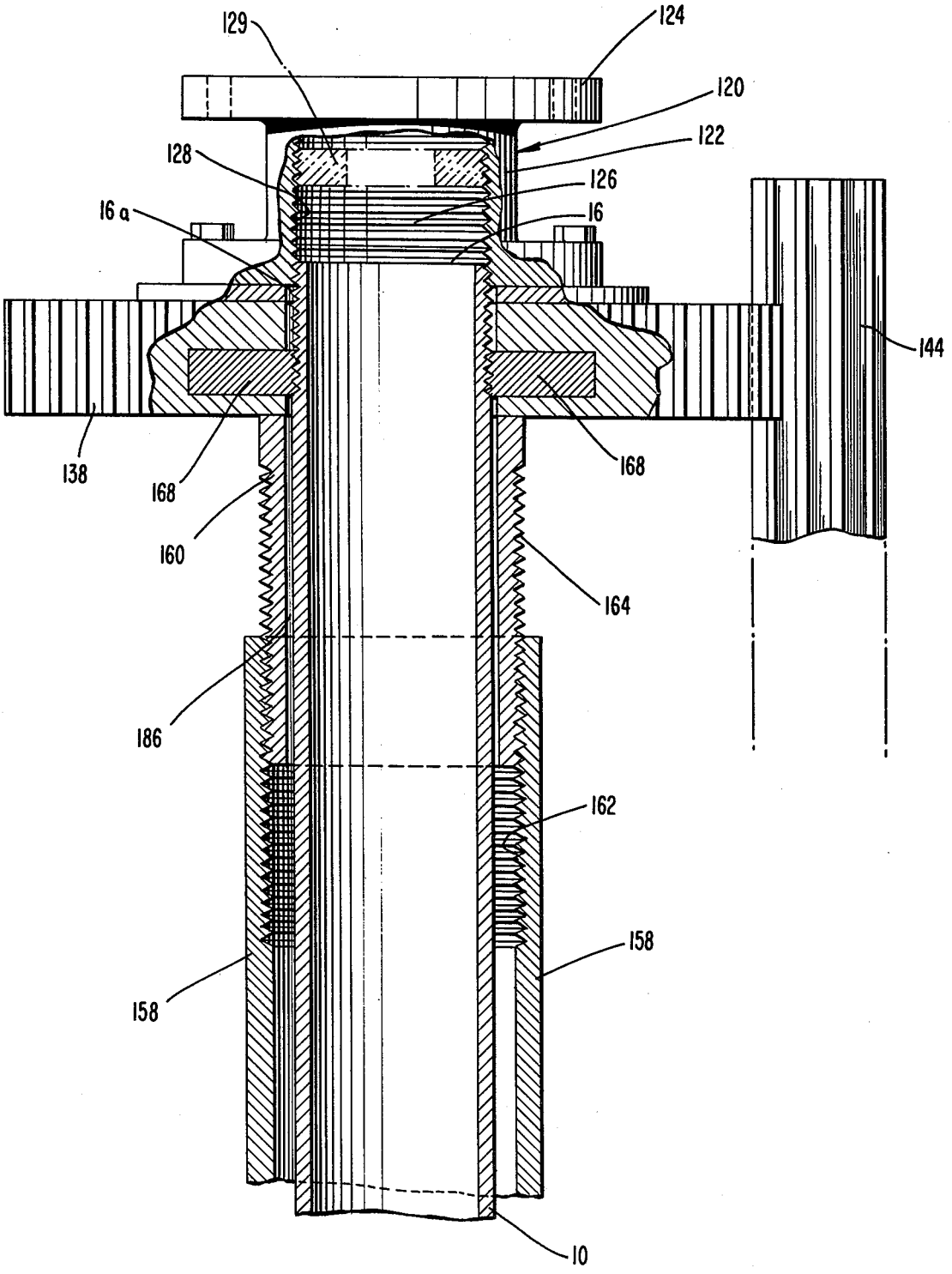
FIG. 4A is a detail of part of the apparatus shown in FIG. 3.
Figure 4B:
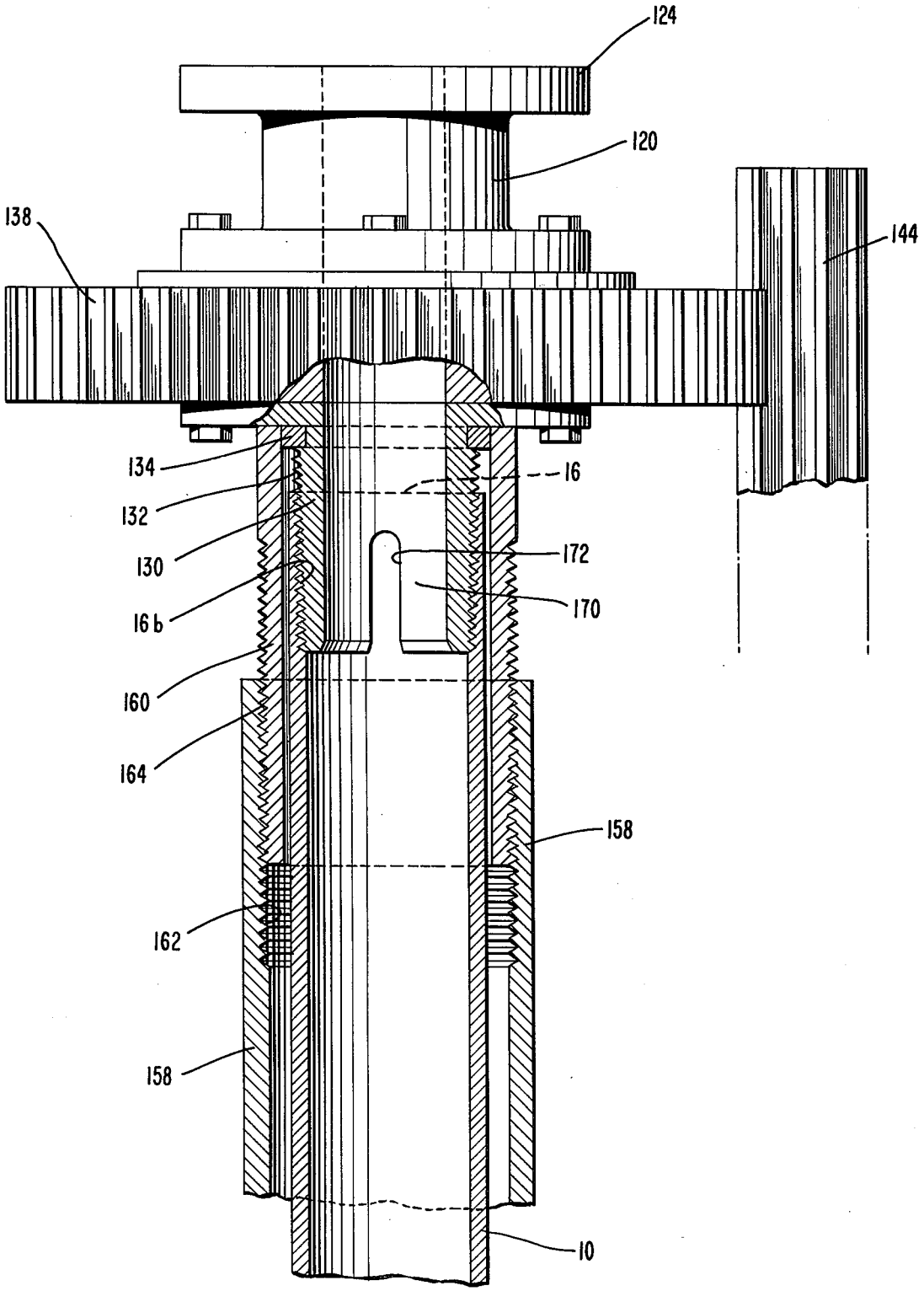
FIG. 4B is alternate construction to the part shown in FIG. 4A.

FIGS. 3–6 present another embodiment of the present invention, namely apparatus generally designated 110 for capping a "blowing" well, which again is represented by pipe stem 10 having open end 16 through which fluid 14 is flowing uncontrollably (see FIGS. 4*a* and 4*b*). As with the embodiment shown in FIGS. 1 and 2, in accordance with the present invention apparatus 110 includes both a valve for finally throttling the fluid flow 14 from the well and means for clamping the apparatus to the pipe stem. As embodied herein, a double-ram piston BOP valve 112, with hydraulic connections 116, functions in essentially the same manner as BOP valve 22 shown in FIGS. 1 and 2. It is also intended that a split-type hydraulically activated clamp 114 (see FIG. 3) similar to clamp 54 of the embodiment shown in FIGS. 1 and 2 be included in apparatus 110. The embodiment of FIGS. 3–6 will thus be seen to differ from the previous embodiment principally in the structure and operation of the means for coupling the valve 112 to the pipe stem and also the means for axially displacing the valve 112 and the pipe coupling means into engagement with the well pipe stem.

In accordance with the invention, and as embodied herein with particular reference to FIG. 3, pipe coupling means designated generally 118 can additionally include means for establishing a threaded connection with the pipe stem 10. As depicted schematically in FIGS. 3, 4*a* and 4*b*, threaded coupling means 118 includes a hollow cylindrical member 120 having a flange 124 in flow connection with valve 112 through spool spacer piece 180 and swivel joint 178 (to be discussed infra). For the case where threads 16*a* are formed on the outside surface of pipe end 16, as depicted in FIG. 4*a*, member 120 includes a collar section 122 with a tapered internal bore 126 having threads 128 thereon for engaging the pipe end threads 16*a* when the collar is rotated and advanced axially against the pipe stem 10 by means that will be discussed henceforth. Threads 16*a* can either be preformed on pipe stem 10 or can be formed during the capping operation using other means associated with the embodiment of the present invention shown in FIGS. 3–6, as will become clear in the subsequent discussion. The tapered bore 126 has a maximum and minimum ID larger and smaller respectively than the OD of pipe stem 10 and will produce a sealing interference fit between collar 122 and pipe stem 10 as the components are rotatingly engaged, as would be appreciated by one of ordinary skill in the art. Sealing rings, such as rings 129 (shown schematically), preferably can be mounted in bore 126 to engage the pipe end 16 to provide additional protection against leakage.

For cases where end 16 of pipe stem 10 is threaded internally with threads 16*b* (either with performed threads or with threads formed by means associated with the apparatus of present invention) as depicted in FIG. 4*b*, cylindrical member 120 includes a hollow tapered plug section 130 having threads 132 formed on the outside tapered surface for engaging the internal threads 16*b* on pipe stem 10. Sealing rings 134 can preferably be included on the OD of the tapered plug 130 to provide additional protection against leakage, although significant sealing is expected due to the interference fit produced as tapered plug 130 is rotataingly advanced into threaded pipe 10 in a manner that will now be discussed.

In accordance with the present invention, and with particular reference to FIG. 3, the axially displacing means can also include means generally designated 136 for rotating the pipe coupling means in axially advancing engagement with the pipe stem whenever a threaded engagement is desired. As embodied herein, rotating means 136 includes spur gear 138 fixedly connected to, and concentric with, cylindrical member 120. Spur gear 138 engages shaft 140 of hydraulic motor 142 through a spline gear 144. Motor 142 is preferably hydraulically activated via hydraulic connections 146, 148, and the housing of motor 142 is fixed to mounting plate 150 which, in turn, is attached to one section of split clamp 114. Shaft 140 is aligned with its axis parallel to the axis of pipe stem 10 and is rotatably supported by mounting plate 150 and by guide plate 152 which is spaced from plate 150 by a pair of spacer rods 154. Both mounting plate 150 and guide plates 152 are fixedly attached to the support rods 154, such as by the weldments depicted in FIG. 3.

As is abundantly clear from FIG. 3, when the motor 142 is activated the rotation of shaft 140 is transmitted through spline 144 to spur gear 138 to provide the required rotary motion to the internally tapered threaded collar sections 122 of cylindrical member 120, for the variation shown in FIG. 4*a*, or to the externally tapered threaded plug section 130 of cylindrical member 120 for the FIG. 4*b* variation. As the spur gear 138, along with cylindrical member 120, moves axially with respect to shaft 140 and spline 144 when the respective threads are engaged, the length of the spline 144 should be made sufficient to accommodate the expected axial movement.

As embodied herein, with continued reference to FIGS. 3, 4*a* and 4*b*, the axially displacing means also includes means generally designated as 156 for axially advancing the pipe-coupling means 118 into engagement with the end 16 of pipe stem 10. Advancing means 156 includes a pair of cylinders 158 and 160 concentrically disposed with one another and with pipe stem 10. Cylinder 158 is internally threaded with threads 162 and is attached to mounting plate 150, such as by weldments as shown in the figure, and thereby fixed relative to clamp 114. Cylinder 160 is positioned inside of cylinder 158 and surrounding pipe stem 10, and is also fixed to cylindrical member 120 such as be weldments. Cylinder 160 has threads 164 on the outer cylindrical surface to mate with threads 162 of cylinder 158. Upon rotation of cylindrical member 120, such as by spur gear 138 being driven by motor 142 through shaft 140 and spline gear 144, the relative rotary motion of threadingly engaged cylinders 158, 160 produce a lead screw effect to axially advance the pipe-coupling means 118 into threaded engagement with pipe stem 10.

To prevent possible jamming interference, it is important that the pitch of threads 162, 164 be identical to the pitch of threads 128, 16*a* for the internally threaded collar 122/externally threaded pipe stem variation shown in FIG. 4*a*, and for the threads 132, 16*b* for the externally threaded plug 130/internally threaded pipe stem shown in FIG. 4*b*. Guide plate 152 can be fixed to outer cylinder 158 such as by weldments for additional support, as is shown in the figure.

Figure 5:
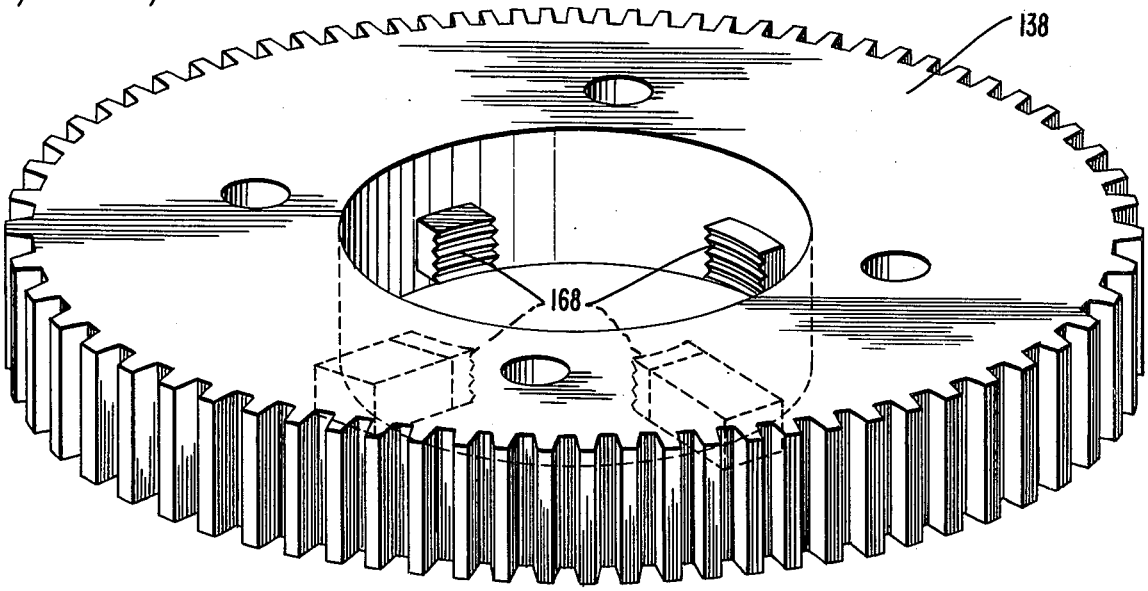
FIG. 5 is a detail of a part of the construction shown in FIG. 4A.

Further in accordance with the present invention, as embodied herein, apparatus 110 includes means for forming threads on the pipe stem 10 at the open end 16. For the variation shown in FIG. 4*a*, (and as best seen in FIG. 5), thread-forming means includes a plurality of external thread cutting dies 168 mounted in the bore of spur gear 138. As spur gear 138 is mounted on cylindrical member 120 below threaded collar portion 122, cutting dies 168 thus first engage pipe stem 10 to form the threads 16*a* on pipe stem 10 and then collar 122 engages the newly threaded pipe stem until an interference fit is reached and/or sealing rings 129 are engaged, collar 122 as well as cutting dies 168 being axially advanced by the action of lead screw cylinders 158, 160. Also considered to be within the scope of the present invention, although not shown, it may be preferred to have collar 122 self-threading instead of employing separate cutting dies 168.

Figure 6:
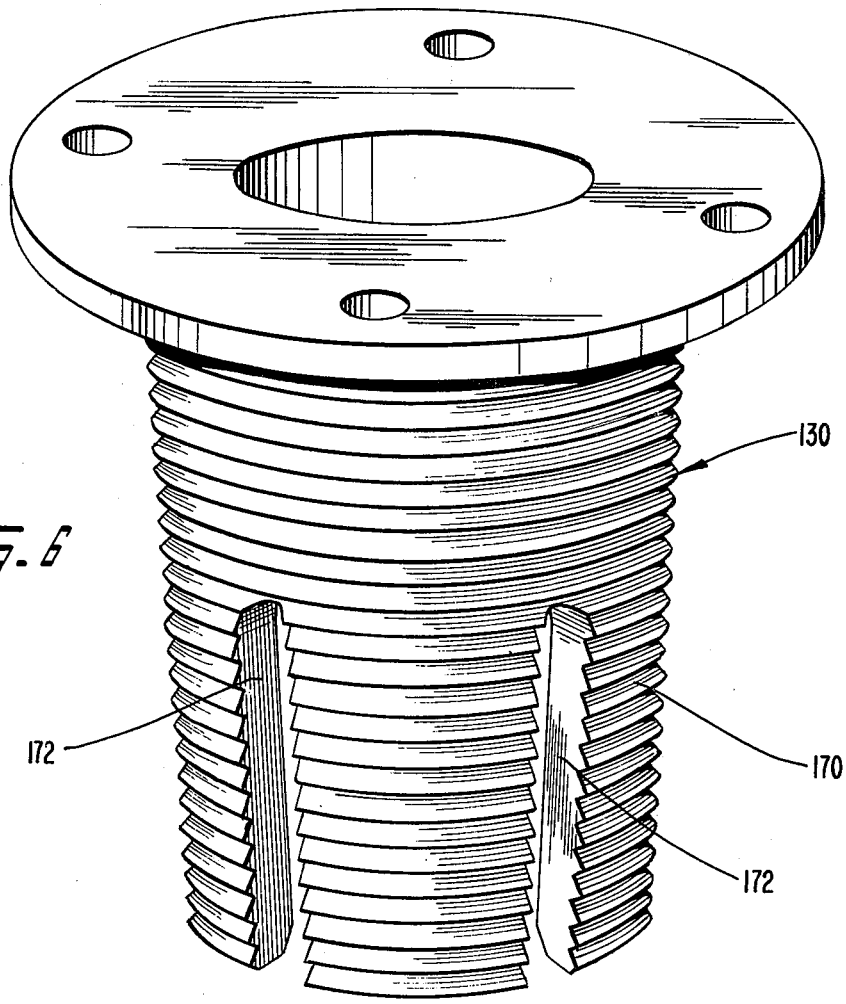
FIG. 6 is a detail of a part of the alternate construction shown in FIG. 4B.

For the variation shown in FIG. 4*b* (and as best seen in FIG. 6), thread-forming means can include internal thread-cutting tap member 170 with chip release flutes 172 attached or (as depicted) integral with the lead end of tapered plug 130. Tap member 170 thus would proceed plug 130 into end 16 of pipe stem 10 to form threads 16b upon rotation of member 120 by spur gear 138 and axial advancememnt by cylinders 158, 160. Upon continued rotation of the cylindrical member 120, the threaded plug 130 would then engage the pipe stem 10 (newly threaded) and continue turning until an interference fit was produced and/or sealing rings 134 were engaged.

Again, it is important that the pitch of the threads cut by dies 168 or tap 170 be identical to the pitch of threads 162, 164 of the paired cylinders 158, 160, respectively, to prevent possible jamming.

Also in accordance with the present invention, means are provided to isolate the valve against turning forces when pipe-coupling means utilizing means for establishing a threaded connection are employed. Allowing rotation of a valve such as BOP valve 112 can tangle hydraulic connections 116 and preclude efficient, safe installation of apparatus 110. As embodied herein, and as seen in FIG. 3, valve isolation means generally designated as 176 includes a swivel joint 178 (such as a "Chiksan" ® swivel joint manufacture by FMC) positioned between BOP valve 112 and cylindrical member 120. Swivel joint 178 allows rotation of cylindrical member 120 fully independent of BOP valve 112 which is keyed to clamp 114, and thus to the pipe stem 10, through key plate 182 via holes 184 in which rods 154 loosely pass. As previously described, rods 154 are fixedly attached to mounting plate 150 which is itself fixed to clamp 114. Key plate 182 is thus free to move axially, but not tangentially, as the cylindrical member 120 is advanced onto pipe stem 10 through the rotation of spur gear 138.

Operation of apparatus 110 is similar to that described in relation to the embodiment shown in FIGS. 1 and 2. Briefly, the apparatus 110 with the split clamp 114 and the BOP valve 112 in the full-open position is manuevered over the pipe stem 10 and is lowered until the axially most advanced portion of cylindrical member 120 first engages end 16 of pipe stem 10. For the variation shown in FIG. 4a, this axially advanced portion would be the external cutting dies 168 in the bore of the spur gear 138. For the variation shown in FIG. 4b, the tap member 170 would first engage the end 16 of pipe stem 10. It is apparent that these axially advanced components of the cylindrical member 120 also serve to properly space the apparatus 110 on the pipe stem 10 before clamp 114 is engaged.

After hydraulic pressure is applied to the hydraulic connections (not shown) to clamp 114 to activate the clamp to engage pipe, hydraulic pressure is applied to hydraulic connection 146, 148 to activate hydraulic motor 142 which, through shaft 140 and spline 144, causes spur gear 138 to rotate member 120 and attached cylinder 160. The subsequent "lead screw" effect of cooperating cylinders 158, 160 causes the cutting dies 168 of the FIG. 4a variation or the tap member 170 of the FIG. 4b variation to begin threading the pipe stem 10, following which a threaded coupling is achieved by collar 122 (FIG. 4a) or threaded plug 130 (FIG. 4b), respectively.

After coupling is achieved, hydraulic pressure is supplied to hydraulic connections 116 to shut BOP valve 112 to stem the flow of fluid 14 and thereby cap the well. Subsequently, as with the embodiment shown in FIGS. 1 and 2, drilling fluids can be pumped into the well to help "kill" it via the flange connections (not numbered) to the BOP valve 112 and/or the well can be tapped to slowly bleed off the fluid through the same connection.

For operations with pipe stems not having preformed threads, it is presently believed that it would be preferable to utilize the variation shown in FIG. 4a in order to provide an external thread on pipe stem 10. Chips formed by the cutting dies 168 would tend to accumulate in annular space 186 (see FIG. 4a) between the cylinder 160 and pipe stem 10 and thus not be entrained by the blowing fluid 14 and possibly lodging in BOP valve 112 and causing jamming of that component. Chips produced by the FIG. 4b configuration must exit the cutting element tap 170 through flutes 172 and be entrained by the flowing fluid 14. However, the high velocity of the fluid 14 may effectively clear chips through the apparatus, in which case the configuration in 4b may be preferred for the positive centering capability afforded by the tapered tap 170. This centering capability is substantially the same function as provided by the smooth tapered plug 48 in the embodiment shown in FIGS. 1 and 2.

Also, while positive coupling achieved by the threaded connections afforded by the embodiment shown in FIGS. 3–6 may provide superior fluid tightness as compared to the press fit achieved by the embodiment shown in FIGS. 1 and 2, the relative simplicity of the latter embodiment may make it preferred if cost and/or reliability are key factors. These considerations are readily understandable by those working in the art given the present disclosure.

It also would be apparent to those skilled in the art that various modifications and variations can be made in the apparatus of the present invention, and in the construction of the apparatus shown in FIGS. 1–6, without departing from the scope or spirit of the invention. Thus, it is intended that the present invention cover such modifications and variations provided that they come within the scope of the appended claims.

What is claimed is:

1. Apparatus for capping a well having a pipe stem through the end of which fluid is flowing uncontrollably, the apparatus comprising:

(a) a valve having a flow passage therethrough;

(b) means connected to said valve for coupling said valve to the pipe stem, said pipe-coupling means also having a flow passage communicating with said valve flow passage;

(c) clamping means for engaging the exterior surface of the pipe stem; and (d) means for connecting said clamping means and said valve for axially aligning the flow passage of said pipe-coupling means with the pipe stem end and for axially displacing the pipe-coupling means relative to said clamping means into fluid-tight engagement with the pipe stem end, said displacing means acting against the pipe stem through said clamping means, wherein said pipe-coupling means includes means for establishing a press-fit connection with the pipe end including a hollow externally tapered plug member having a minimum and maximum outside diameter respectively less than and greater than the inside diameter of the pipe stem, and wherein the outside surface of said plug member is generally smooth and the taper of said plug is such to create said press-fit sealing relationship with the interior of the pipe stem when said plug member is displaced substantially axially into the end of the pipe stem.

2. Apparatus as in claim 1 wherein said valve is a double-ram piston, hydraulically-activated blow-out preventor valve.

3. Apparatus as in claim 1 wherein said clamping means includes a split-type clamp having a plurality of hardened jaws for securingly engaging the pipe stem outer wall and preventing motion relative to the pipe stem.

4. Apparatus as in claim 1 wherein sealing rings are mounted on the outer tapered surface of said plug member.

5. Apparatus as in claim 1 wherein said valve, said pipe-coupling means, said clamping means, and said displacing means are all adapted for underwater operations.

6. Apparatus as in claim 1 wherein at least one of said valve, said clamping means and said displacing means is hydraulically activated.

7. Apparatus as in claim 1 wherein said displacing means includes a plurality of hydraulic cylinders connecting said clamping means and said pipe-coupling means, the axes of said cylinders being oriented parallel to the axis of the pipe stem.

8. Apparatus as in claim 1 wherein said valve, said clamping means, and said displacing means are all hydraulically activated, and wherein said apparatus further includes means for selectively controlling hydraulic pressure to said valve, said clamping means, and said displacing means.

9. Apparatus for capping a well having a pipe stem through the end of which fluid is flowing uncontrollably, the apparatus comprising:

(a) a valve having a flow passage therethrough;

(b) means connected to said valve for coupling said valve to the pipe stem, said pipe-coupling means having a threaded sealing member with a flow passage therethrough communicating with said valve flow passage, said pipe-coupling means also including means for forming threads on the pipe stem adjacent the pipe stem end;

(c) clamping means for engaging the exterior surface of the pipe stem; and (d) means for connecting said clamping means and said valve for axially aligning the flow passage of said pipe-coupling means with the pipe stem end and for axially displacing the pipe-coupling means into fluid-tight engagement with the pipe stem end, said displacing means further including means for rotating said threaded sealing-member means in axially advancing engagement with the threaded pipe stem end, said forming means and said rotating means each acting against the pipe stem through said clamping means, wherein said formed threads are located on the outside surface of the pipe stem, and wherein said threaded sealing member is a collar member having a hollow tapered threaded bore for sealingly mating with the externally threaded pipe stem.

10. Apparatus as in claim 9 wherein the maximum and minimum inside diameter of the hollow collar member is respectively greater and less than the outside diameter of the pipe stem.

11. Apparatus as in claim 10 wherein sealing rings are mounted on the inner surface of said hollow collar member.

12. Apparatus as in claim 9 wherein said collar is self-threading, said self-threading collar member also constituting said thread forming means.

13. Apparatus as in claim 9 wherein said thread-forming means also spaces said clamping means along the pipe stem relative to the pipe stem end during installation of said apparatus on the pipe stem.

14. Apparatus as in claim 9 wherein said thread-forming means includes at least one external-thread-cutting die connected to, and constrained to rotate with, said collar member.

15. Apparatus as in claim 9 wherein said thread-forming means serves to locate said clamping means along the pipe stem prior to activation of said clamping means.

16. Apparatus as in claim 9 wherein said valve, said pipe-coupling means, said clamping means, and said displacing means are all adapted for underwater operation.

17. Apparatus as in claim 9 wherein said means for rotating said pipe-coupling means includes a hydraulic motor operatively connected to said pipe-coupling means.

18. Apparatus as in claim 9 further including means for isolating said valve against the rotary motion of said pipe coupling means.

19. Apparatus for capping a well having a pipe stem through the end of which fluid is flowing uncontrollably, the apparatus comprising:

(a) a valve having a flow passage therethrough;

(b) means connected to said valve for coupling said valve to the pipe stem, said pipe-coupling means having a threaded sealing member with a flow passage therethrough communicating said valve flow passage, said pipe-coupling means also including means for forming threads on the pipe stem adjacent the pipe stem end;

(c) clamping means for engaging the exterior surface of the pipe stem; and (d) means for connecting said clamping means and said valve for axially aligning the flow passage of said pipe-coupling means with the pipe stem end and for axially displacing the pipe-coupling means into fluid-tight engagement with the pipe stem end, said displacing means further including means for rotating said threaded sealing-member means in axially advancing engagement with the threaded pipe stem end, said forming means and said rotating means each acting against the pipe stem through said clamping means, wherein said formed threads are located on the inside surface of the pipe stem, and wherein said threaded sealing member is an externally tapered plug member having a hollow bore and a threaded outside surface for sealingly mating with the internally threaded pipe stem, and wherein said thread-forming means includes a thread-cutting tap member connected to, and constrained to rotate with, said plug member.

20. Apparatus as in claim 19 wherein said plug member is externally tapered having a minimum and maximum outside diameter respectively less than and greater than the inside diameter of the pipe stem.

21. Apparatus is in claim 20 wherein said sealing rings are mounted on the external surface of said plug member.

22. Apparatus as in claim 19 wherein said plug member is self-threading, said self-threading plug member also constituting said thread-forming means.

23. Apparatus as in claim 19 wherein said valve, said pipe-coupling means, said clamping means, and said displacing means are all adapted for underwater operation.

24. Apparatus as in claim 19 wherein said means for rotating said pipe-coupling means includes a hydraulic motor operatively connected to said pipe-coupling means.

25. Apparatus as in claim 19 further including means for isolating said valve against the rotary motion of said pipe coupling means.

26. Apparatus for capping a well having a pipe stem through the end of which fluid is flowing uncontrollably, the apparatus comprising:

(a) a valve having a flow passage therethrough;

(b) means connected to said valve for coupling said valve to the pipe stem, said pipe-coupling means having a threaded sealing member with a flow passage therethrough communicating with said valve flow passage, said pipe-coupling means also including means for forming threads on the pipe stem adjacent the pipe stem end;

(c) clamping means for engaging the exterior surface of the pipe stem; and (d) means for connecting said clamping means and said valve for axially aligning the flow passage of said pipe-coupling means with the pipe stem end and for axially displacing the pipe-coupling means into fluid-tight engagement with the pipe stem end, said displacing means further including means for rotating said threaded sealing-member means in axially advancing engagement with the threaded pipe stem end, said forming means and said rotating means each acting against the pipe stem through said clamping means, and wherein said rotating means includes means connected between said clamping means and said pipe-coupling means for advancing said thread-forming means along the pipe stem at the same rate the threads are being formed by said thread-forming means.

27. Apparatus as in claim 26 wherein said advancing means includes mated threaded components, the thread of said mated components having the same pitch as the thread being formed on the pipe stem.

28. Apparatus as in claim 27 wherein said components include an interiorly threaded first cylinder fastened to said clamping means and positioned to loosely surround the pipe stem and an exteriorly threaded second cylinder connected to rotate with said pipe-coupling means and positioned inside of, and threadingly engaged to, said first cylinder, whereby rotation of said pipe-coupling means causes axial advancement of said second cylinders within said first cylinder and axial movement of said thread-forming means along the pipe stem.

29. Apparatus as in claim 26 wherein said advancing means also assists in axially advancing said threaded sealing member into fluid-tight engagement with the threaded pipe stem end after the threads are formed thereon.

30. Apparatus as in claim 26 wherein said valve, said pipe-coupling means, said clamping means, said displacing water, and said advancing means are all adapted for underwater operation.

31. Apparatus as in claim 26 wherein said means for rotating said pipe-coupling means includes a hydraulic motor operatively connected to said pipe-coupling means.

32. Apparatus as in claim 31 wherein said motor is mounted on said clamping means and is geared to said pipe-coupling means.

33. Apparatus as in claim 31 wherein a spur gear is mounted on and concentric with said pipe-coupling means, said motor has a rotating splined output shaft and is mounted parallel to the pipe stem, and said splined shaft engages said spur gear.

34. Apparatus as in claim 26 further including means for isolating said valve against the rotary motion of said pipe coupling means.

* * * * *